US007815790B2

(12) United States Patent
Leta et al.

(10) Patent No.: US 7,815,790 B2
(45) **Date of Patent: *Oct. 19, 2010**

(54) UPGRADE OF VISBROKEN RESIDUA PRODUCTS BY ULTRAFILTRATION

(75) Inventors: Daniel P. Leta, Flemington, NJ (US); Leo D. Brown, Baton Rouge, LA (US); David T. Ferrughelli, Flemington, NJ (US); Stephen M. Cundy, Lebanon, NJ (US); MaryKathryn Lee, Plainfield, NJ (US); Copper E. Haith, Bethlehem, PA (US); Eric B. Sirota, Flemington, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 324 days.

This patent is subject to a terminal disclaimer.

(21) Appl. No.: 11/980,160

(22) Filed: Oct. 30, 2007

(65) Prior Publication Data

US 2009/0057198 A1 Mar. 5, 2009

Related U.S. Application Data

(60) Provisional application No. 60/966,473, filed on Aug. 28, 2007.

(51) Int. Cl.
*C10G 9/00* (2006.01)

(52) U.S. Cl. ..... 208/67; 208/95; 208/97; 208/106

(58) Field of Classification Search ..... 208/67–70, 208/95, 97, 106
See application file for complete search history.

(56) References Cited

U.S. PATENT DOCUMENTS

| | | | |
|---|---|---|---|
| 2,947,687 | A | 10/1954 | Lee |
| 3,684,697 | A | 8/1972 | Gamson |
| 3,919,075 | A | 11/1975 | Parc et al. |
| 3,990,963 | A | 11/1976 | Audibert et al. |
| 4,115,465 | A | 9/1978 | Elfert et al. |

(Continued)

FOREIGN PATENT DOCUMENTS

CA 2185264 9/1996

(Continued)

OTHER PUBLICATIONS

Lai, W.C. et al. (2001). Fuel, 80, 1121-1130.*

(Continued)

*Primary Examiner*—Robert J Hill, Jr.
*Assistant Examiner*—Brian McCaig
(74) *Attorney, Agent, or Firm*—Bruce M. Bordelon

(57) ABSTRACT

This invention relates to a process of producing an upgraded product stream from the products of a resid visbreaking process to produce an improved feedstream for refinery and petrochemical hydrocarbon conversion units. This process utilizes an ultrafiltration process for upgrading select visbreaking process product streams to produce a conversion unit feedstream with improved properties for maximizing the conversion unit's throughput, total conversion, run-time, and overall product value.

18 Claims, 2 Drawing Sheets

U.S. PATENT DOCUMENTS

| | | | | |
|---|---|---|---|---|
| 4,120,900 | A | 10/1978 | Evers et al. | |
| 4,134,824 | A | 1/1979 | Kamm et al. | |
| 4,169,782 | A | 10/1979 | Thompson | |
| 4,259,170 | A | 3/1981 | Graham et al. | |
| 4,411,790 | A | 10/1983 | Arod et al. | |
| 4,504,377 | A | 3/1985 | Shu et al. | |
| 4,592,832 | A | 6/1986 | Bristow et al. | |
| 4,617,126 | A | 10/1986 | Funk et al. | |
| 4,661,241 | A | 4/1987 | Dabkowski et al. | |
| 4,797,200 | A | 1/1989 | Osterhuber | |
| 4,814,088 | A | 3/1989 | Kutowy et al. | |
| 4,816,140 | A | 3/1989 | Trambouze et al. | |
| 4,874,523 | A | 10/1989 | LaFreniere | |
| 4,892,660 | A | 1/1990 | Sweet | |
| 4,908,134 | A | 3/1990 | Anderson | |
| 4,946,594 | A | 8/1990 | Thaler et al. | |
| 4,963,303 | A | 10/1990 | Anderson | |
| 4,978,454 | A | 12/1990 | Sweet | |
| 4,982,051 | A | 1/1991 | Pasternak et al. | |
| 5,045,206 | A | 9/1991 | Chen et al. | |
| 5,045,354 | A | 9/1991 | Feimer et al. | |
| 5,107,056 | A | 4/1992 | Chen et al. | |
| 5,107,058 | A | 4/1992 | Chen et al. | |
| 5,107,059 | A | 4/1992 | Chen et al. | |
| 5,173,172 | A | 12/1992 | Adams et al. | |
| 5,180,496 | A | 1/1993 | Sartori et al. | |
| 5,191,151 | A | 3/1993 | Eriksen et al. | |
| 5,256,297 | A | 10/1993 | Feimer et al. | |
| 5,514,252 | A | 5/1996 | Kerby, Jr. et al. | |
| 5,635,055 | A | 6/1997 | Sweet et al. | |
| 5,643,442 | A | 7/1997 | Sweet et al. | |
| 5,749,943 | A | 5/1998 | Shimazu et al. | |
| 5,785,860 | A | 7/1998 | Smith | |
| 5,979,178 | A | 11/1999 | Engler et al. | |
| 6,180,008 | B1 | 1/2001 | White | |
| 6,187,987 | B1 | 2/2001 | Chin et al. | |
| 6,190,533 | B1 | 2/2001 | Bradow et al. | |
| 6,524,469 | B1 | 2/2003 | Schucker | |
| 6,525,469 | B1 | 2/2003 | Huang et al. | |
| 6,896,796 | B2 | 5/2005 | White et al. | |
| 7,018,517 | B2 | 3/2006 | Kurita et al. | |
| 7,041,212 | B2 | 5/2006 | White et al. | |
| 7,048,846 | B2 | 5/2006 | White et al. | |
| 2003/0019790 | A1* | 1/2003 | Schucker | 208/96 |
| 2004/0026321 | A1 | 2/2004 | Minhas et al. | |
| 2004/0251166 | A1* | 12/2004 | Alvarenga Baptista et al. | 208/78 |
| 2004/0251201 | A1 | 12/2004 | Chau et al. | |
| 2006/0016727 | A1 | 1/2006 | Varadaraj | |
| 2006/0231462 | A1 | 10/2006 | Johnson | |
| 2007/0090020 | A1 | 4/2007 | Buchanan et al. | |
| 2008/0116109 | A1 | 5/2008 | McCoy et al. | |

FOREIGN PATENT DOCUMENTS

| | | | |
|---|---|---|---|
| EP | 0160142 | | 11/1985 |
| EP | 0254359 | B1 | 1/1988 |
| EP | 0146298 | B1 | 5/1991 |
| EP | 0489573 | B1 | 9/1995 |
| GB | 1266180 | | 12/1969 |
| GB | 2268186 | | 1/1994 |
| JP | 54013509 | | 7/1977 |
| JP | 2000288371 | | 4/1999 |
| JP | 2001038159 | | 8/1999 |
| KR | 2002007235 | | 1/2002 |
| WO | WO 00/06526 | | 2/2000 |
| WO | WO 01/60771 | A1 | 8/2001 |
| WO | WO 02/50212 | A2 | 6/2002 |
| WO | WO 03/026781 | A1 | 4/2003 |
| WO | WO 2004/018067 | A2 | 3/2004 |
| WO | WO 2006/040328 | A1 | 4/2006 |

OTHER PUBLICATIONS

V. S. Ravi-Kumar, Theodore T. Tsotsis, Muhammad Sahimi; "Studies of Transport of Asphaltenes through Membranes Using Hindered Diffusion Theories for Spheres and Spheroids," Ind. Eng. Chem. Res. 1997, 36, pp. 3154-3162.

Anna Duong, Goutam Chattopadhyaya, Wellington Y. Kwok, Kevin J. Smith; "An experimental study of heavy oil ultrafiltration using ceramic membranes," Fuel, vol. 76, No. 9, pp. 821-828, 1997.

B. D. Sparks, J. D. Hazlett, O. Kutowy, T. A. Tweddle; "Upgrading of Solvent Extracted Athabasca Bitumen by Membrane Ultrafiltration," AIChe Journal, Aug. 1990, vol. 36, No. 8, pp. 1279-1282.

Bruce Bishop, Robert Goldsmith, Robert Schucker, Keith Rawlins; "Ceramic Membrane Process for Upgrading Vacuum Residual Oil," Presentation at AIChE 2004 Spring Annual Meeting, New Orleans, LA, Apr. 25-29, 89d.

W. C. Lai, K. J. Smith; "Heavy oil microfiltration using ceramic monolith membranes," Fuel 80 (2001) pp. 1121-1130.

J. D. Hazlett, O. Kutowy, T. A. Tweddle, B. A. Farnand; "Processing of crude oils with polymeric ultrafiltration membranes," AIChE 1989 Spring National Meeting (Houston Apr. 2-6, 1989) AIChE Symposium Series V85 N. 272, 101-107 (1989).

Deqing Shi, Hongwei Yu, Jinrong Yang, Zhihau Zhang,Ying Kong; "Study on the separation performance of polyimide nanofiltration membrane for solvent recovery in the butanone-toluene dewaxing process of lube oil," Mo Kexue Yu Jishu (2005), 25(3), 50-53, 62. Abstract.

Zhi-Ping Zhao, Jiding Li, Jian Chen, Cui-Xian Chem; "Nanofiltration membrane prepared from polyacrylonitrile ultrafiltration membrane by low-temperature plasma," Journal of Membrane Science (2005), 251(1-2), 239-245. Abstract.

F. Petrus Cuperus, Katrin Ebert; "Non-aqueous application of NF," Nanofiltration (2005), 521-536, Editor(s): Schafer, A.I.; Fane, A.G.; Waite, Thomas D., Publisher: Elsevier Ltd., Oxford, UK. Abstract.

B. Bishop, R. Goldsmith, R. Schucker, K. Rawlins; "Ceramic membrane process for upgrading vacuum residual oil," 2004 AIChE Spring Meeting, Conference Proceedings, New Orleans, LA, 7p (2004) Abstract.

M. V. Veazey; "Tech trends: Microfiltration system," Materials Performance 43/5 15 (May 2004), Abstract.

T. Melin, M. Gallenkemper, J. Hoppe, C. Matthias, "Achema reports . Membrane engineering," Chemie-Ingenieur-Technik (Achema 2003 27(sup) t(sup) h International Exhibition-Congress on Chemical Engineering, 76/12 1869-1876, Dec. 2003., Abstract.

V. I. Il'In, V. A. Kolesnekov, A. V. D'Yachenko; "Electrically insulating petroleum oils and their refining," Oboronnyi Kompleks—Nauchno-Tekhnicheskomu Progressu Rossii (2002), (4), 69-71. Abstract.

A. P. Aleksandrtn, A. A. Egorshev, O. V. Katsereva, E. A. Komyagin, V. N. Mynin, G. V. Terpugov; "Use of ceramic membranes for treatment end regeneration of depleted petroleum products," Tyazh. Mashinostr. -/6 30-32 (2002) Chemical Abstracts 138/5-6 Abstr. No. 58512 (2003). Abstract.

"Process industries exposition: Membrane rejects emulsified oils while maintaining hydrophilic properties," Chemical Engineering Progress 97/4 26 (Apr. 2001). Abstract.

K. J. Smith, W. C. Lai; "Heavy oil microfiltration using ceramic monolith membranes," Fuel, 80/8, 1121-1130 (Jun. 2001). Abstract.

R. M. Gould, L. S. White, C. R. Wildemuth; "Membrane separation in solvent lube dewaxing," Environmental Progress, 20/1, 12-16 (Apr. 2001). Abstract.

N. A. Bhore, R. M. Gould, S. M. Jacob, P. O. Staffeld, D. McNally, P. H. Smiley, C. R. Wildemuth; "New membrane process debottlenecks solvent dewaxing unit," Oil and Gas Journal, 97/46, 67-68, 70, 72-24 (Nov. 15, 1999). Abstract.

Jiao-Li Li, Xu-Xiang Li, Bing-Hua Ni; "Development of ultrafiltration and its application in recovery of dewaxing solvent," Shihua Jishu Yu Yingyong (2000), 18(5), 295-297, 301. Abstract.

S. Elmaleh, N. Ghaffor; "Upgrading oil refinery effluents by cross-flow ultrafiltration," Water Science & Technology, 34(9), 231-238 (1996), Aqualine Abstracts Abstr. No. 97-4463 V13 N.9 (Sep. 1997). Abstract.
B. Park, V. S. Ravi-Kumar, T. T. Tsotsis; "Models and simulation of liquid—phase membrane reactors," Industrial & Engineering Chemistry Research, V37 N. 4, 1276-89 (Apr. 1998). Abstract.
A. Duong, K. J. Smith; "A model of ceramic membrane fouling during heavy oil," Canadian Journal of Chemical Engineering, V75 N. 6, 1122-29 (Dec. 1997). Abstract.
M. Garcia Sanchez, J. L. Perez Pavon, B. Moreno Cordero; J. Chromatogr., A, 766 (1+2), 61-69 (1997) Chemical Abstracts Abstr. No. 319181 V126 N. 24. Abstract.
V. S. Ravi-Kumar, T. T. Tsotsis, M. Sahimi; "Studies of the transport of asphaltenes through membranes using hindered diffusion theories for spheres and spheroids," Industrial & Engineering Chemistry Research, V36 N. 8, 3154-62 (Aug. 1997). Abstract.
V. S. Ravi-Kumar, L. Yang, T. T. Tsotsis; "Liquid-phase reactive applications with inorganic membranes : Models and experiments," ACS 214$^{th}$ National Meeting (Las Vegas Sep. 7-11, 1997) Book of Abstracts Part 2 Abstr. No. PMSE-273 (1997). Abstract.
A. Duong, G. Chattopadhyaya, W. Y. Kwok, K. J. Smith; "An experimental study [using Cold Lake (Alberta) oil] of heavy oil ultrafiltration using [single-tube] ceramic membranes," Fuel, V76, N. 9, 821-28 (Jul. 1997). Abstract.
S. Elmaleh, N. Ghaffor; "Upgrading oil refinery effluents by cross-flow ultrafiltration," Water Sci. Technol., 34(9), Water Quality International '96 Part (2), 231-238 (1996) Chemical Abstracts Abstr. No. 79315, V126 N. 6. Abstract.
E. Beaver, Siegel; Technologies critical to a changing world / Clean technologies), AIChE et al. 5$^{th}$ World Chemical Engineering Congress (San Diego Jul. 14-18, 1996) Summary Proceedings 100-03, 159-61 (Oct. 1996). Abstract.
W. Ying, B. Tansel; "Effect of coagulation on fouling rate and cleanability of ultrafiltration membranes," Purdue University 50$^{th}$ Industrial Waste Conference (West Lafayette, IN May 8-10, 1996) Proceedings 285-95 (1995). Abstract.
J. L. Humphrey; "Separation processes: Playing a critical role," Chemical Engineering Progress, V91, N. 10, 31-41 (Oct. 1995). Abstract.
V. N. Zrelov, N. G. Postnikova, L. V. Krasnaya; "Rapid membrane (diffusion) methods for determining mechanical impurities in liquid petroleum products," Khimiya I Tekhnologiya Topliv i Masel, N. 4, 28-30 (1994). Abstract.
B. D. Sparks, J. D. Hazlett, O. Kutowy, T. A. Tweddle, Union Carbide Corp.; "Upgrading of solvent extracted Athabasca bitumen by membrane ultrafiltration," AIChE Journal V36, N. 8, 1279-82 (Aug. 1990). Abstract.
R. J. Torres-Ordonez, S. G. Kukes, F. S. Lee, D. C. Cronauer; "Characterization of solids from coal/resid(ue) coprocessing," ACS 200$^{th}$ National Meeting (Washington, DC Aug. 26-31, 1990) ACS Division of Fuel Chemistry Preprints V35 N.4, 1048-55 (1990). Abstract.
J. D. Hazlett, O. Kutowy, T. A. Tweddle, B. A.Farnand; "Processing of Crude Oils with Polymeric Ultrafiltration Membranes," Nat'l. Res. Counc. Can.; Can. Cent. Miner. Energy Technol, 1989 AIChE Spring Nat'l Meeting (Houston Apr. 2-6, 1989), Prepr. N. 64f 18P.
B. D. Sparks, J. D. Hazlett, O. Kutowy, T. A. Tweddle; "Upgrading of solvent extracted Athabasca bitumen by Membrane ultrafiltration," AIChE 1987 Summer Natl. Meet. (Minneapolis Aug. 16-19, 1987 Prepr. N. 7D 22P. Abstract.
M. Nishimura; "Application and development of membrane separation processes in oil chemistry and its related fields," Yakagaku, 34(3), 171-7 (1985), Chem. Abstr. Abstr. No. 168846 V102 N. 20. Abstract.
D. S. Schuster, C. A. Irani; "Understanding the pour point depression mechanism-2, microfiltration analysis of crude oils," 189$^{th}$ ACS Natl. Meet. (Miami Beach Apr. 28-May 3, 1985) ACS Div. Fuel Chem. Prepr. V30 N.1, 169-77 (1985). Abstract.
J. Durandet; "Separation (Processes) in the refining industry/introduction separations dans le raffinage/introduction," Pet. Tech. N.298 5-6 (May 1983). Abstract.
J. Briant, G. Hotier; "The state of asphaltenes in hydrocarbon mixtures the size of molecular clusters," Rev. Inst. Fr. Pet. V38 N.1 83-100 (Jan.-Feb. 1983). Abstract.
D. Defives, R. Avrillon, C. Miniscloux, R. Roullet, X. Marze; "Regeneration of used lubricating oils by ultrafiltration," Informations Chimie (1978), 175, 127-31. Abstract.
A. Duong, K. Smith, JCS University of British Columbia; Canadian Journal of Chemical Engineering V75 N. 6, 1122-29 (Dec. 1997). Abstract.
V. N. Zrelov, N. G. Postnikova, L. V. Krasnaya; "Analytical filtration of petroleum and synthetic products through membranes," Khim. Tekhnol. Topl. Masel (1984), (11), 32-4. Abstract.
R. J. Thrash, R. H. Pildes; "The diffusion of Petroleum asphaltenes (from a Middle East high-sulfur vacuum residuum) through well characterized (MICA) porous membranes," 181$^{st}$ ACS Natl. Meet (Atlanta Mar. 29-Apr. 3, 1981) ACT Div. Pet. Chem. Prepr. V26 N.2515-25 (Mar. 1981). Abstract.
D. D. Spatz; "Ultrafiltration . . . The membranes, the process, and its application to organic molecule fractionation (Including industrial oil/water separations," 178$^{th}$ ACS Natl. Meet. (Washington, DC Sep. 9-14, 1979) Abstr. Pap. Abstr No. Coll-125. Abstract.
G. Sartori, W. S. Ho, R. E: Noone, B. H. Ballinger; "(New) poly(fluoroolefin) membranes for aromatics/saturates separation," AIChE 1997 Annual Meeting (Los Angeles Nov. 16-21, 1997) Preprint N.32d 6P. Abstract.
V. S. Ravi-Kumar, I. A. Webster, T. T. Tsotsis, R. C. Sane, M. Sahimi; "Studies of diffusion of petroleum liquid macromolecules through model membranes," AIChE 1992 Annual Meeting (Miami Beach Nov. 1-5, 1992) Preprint N.22g 3P. Abstract.
R. C. Sane, I. A. Webster, T. T. Tsotsis, V. S. Ravi-Kumar; "Studies of asphaltene diffusion and structure and their implications for resid(uum) upgrading," 12$^{th}$ International "Chemical Reaction Engineering Today" Symposium (Turin, Italy Jun. 28-Jul. 1, 1992) Chemical Engineering Science V47 N.9-11 2683-88 (Jun.-Aug. 1992). Abstract.
R. C. Sane; "The diffusion of petroleum asphaltenes in porous membranes," University of Southern California, Dissertation (1991) (Abstract) Dissertation Abstracts International: Section B Science & Engineering V52 N.8 4350-B (Feb. 1992). Abstract.
Yong Woo Rho, Hwayong Kim, Won Hee Park; "Effect of oil viscosity on ultrafiltration flux," Hwahak Konghak (1989), 27(4), 446-50. Abstract.
Yujun Song, Fuan Liu, Yong Yang, Jian Zou, Benhui Sun, Tianyuan Zhong; "Review on the preparation and application of nanofiltration membrane," Huagong Keji (1999), 7(3), 1-7. Abstract.
May-Britt Haag; "Membranes in chemical processing. A review of applications and novel developments," Separation and Purification Methods (1998), 27(1), 51-168. Abstract.
H. Zuern, K. Kohlhase,K. Hedden, J. Weitkamp; "Developments in refinery technology-1. Process technology, processing of crudes, residua, and heavy oils," 50$^{th}$ DGMK Anniv. Meet (Berline Nov. 24-26, 1983) Erdoel Kohle, Erdgas, Petrochem. Brennst. Chem. V37 N.2 52-69 (Feb. 1984). Abstract.
R. E. Baltus, J. L. Anderson; "Hindered diffusion of asphaltenes through microporous membranres," Chemical Engineering Science (1983), 38(12) 1959-69. Abstract.
A. Duong, K. J. Smith; "A model of ceramic membrane fouling during heavy oil utlrafiltration," Canadian Journal of Chemical Engineering V75 N.6 1122-29 (Dec. 1997). Abstract.

* cited by examiner

UPGRADE OF VISBROKEN RESIDUA PRODUCTS BY ULTRAFILTRATION

This Application claims the benefit of U.S. Provisional Application No. 60/966,473 filed Aug. 28, 2007.

FIELD OF THE INVENTION

This invention relates to a process of producing an upgraded product stream from the products of a resid visbreaking process to produce an improved feedstream for refinery and petrochemical hydrocarbon conversion units. This process utilizes an ultrafiltration process for upgrading select visbreaker product streams into improved product streams that may be utilized as an improved quality feed for subsequent refinery catalytic conversion units.

BACKGROUND OF THE INVENTION

Visbreaking processes for mild conversion of resid feeds are well known in the art. These processes are utilized to perform a thermal, usually non-catalytic, partial conversion of a heavy hydrocarbon stream into lighter hydrocarbon products. Preferred heavy hydrocarbon feedstream to the visbreaking process are those that have an initial boiling point above 600° F. (316° C.), more preferably above about 800° F. (427° C.). Preferred visbreaker feeds may be comprised of crude atmospheric tower bottoms, crude vacuum tower gas oils and/or crude vacuum tower bottoms.

Visbreaker feedstreams are generally comprised of high molecular weight paraffins, aromatics, asphaltenes, as well as aromatics and asphaltenes with paraffinic side chains. These feedstreams are usually highly viscous with viscosities generally from about 20 to about 1500 centistokes at 212° F. (100° C.). The visbreaking process can be utilized to thermally crack these highly viscous, high molecular weight hydrocarbons into lighter, less viscous products. Preferably, a significant amount of products can be converted into the naphtha boiling range products (boiling range of about 80° F. to about 450° F.), and distillate to gas oil range products (boiling range of about 350° F. to about 800° F.). However, excessive severity (i.e., conversion to lighter products) in a visbreaking process can lead to several problems. For a given unit and feedstream, the severity of the unit is generally a function of the temperature at which the feedstream leaves the visbreaker reactor.

Firstly, high severities can result in an overabundance of light gases generated from the visbreaking process. These light gas products are generally of low economic value and therefore undesired reaction products. Secondly, high severities can result in highly aromatic product streams. These highly aromatic product streams may be of limited value for use in commercial fuels products due to restrictions on aromatic fuel contents and may also cause the fuel products to be excessively unstable. These products may polymerize and develop waxes bringing the desired products out of required fuel specifications as well as causing pluggage problems in associated equipment.

Another more severe problem is that high severity of visbreaking can result in an excessive amount of coke formation in the visbreaking unit. Although facilities and operating conditions may minimize as well as remove some of the coke formation in the unit, the coke production and formation in the visbreaking units increases with increasing severity and operating temperature. As a result, visbreaker units must be taken out of service at periodic intervals in order to remove the coke that forms in the unit. Lower severity operations increases the available on-stream time of these units. Therefore, for the reasons above, it is desirable to run the visbreaker unit within a threshold severity and reactor outlet temperature.

Some visbreaker units include the use of a soaker drum between the visbreaking reactor and the visbreaker fractionator. The soaker drum allows the visbroken product stream leaving the visbreaking reactor to have additional residence time at the heated temperature prior to being quenched in the visbreaker fractionator. This additional residence time allows the visbreaker reactor to be run at a lower outlet temperature when achieving a similar conversion as to a visbreaker unit without a soaker drum. However, although the use of a soaker drum in the visbreaking process assists in reducing coke formation in the unit thereby obtaining longer on-stream intervals, this configuration does not generally result in significant improvement in the product stream composition.

Due to the limited severity that the visbreaker unit may run, there is still a large amount of the product from the visbreaker reactor that is in the heavy gas oil range (550° F. to about 800° F.) as well as visbreaker bottoms which generally have boiling points above 750° F. (399° C.), more typically above about 800° F. (427° C.).

A problem that exists is that the heavy gas oil range products from the visbreaker contain significant amounts of aromatic hydrocarbons. Although it is often desired to further catalytically crack these gas oil range materials into lighter fuels such as naphthas or gasolines, these highly aromatic feedstreams can result in excessive coke formation on the cracking catalysts (e.g., a fluid catalytic cracking or hydrocracking catalyst) resulting in decreased catalytic activity, as well as increased unwanted processing unit emissions (such as CO and $CO_2$).

Similarly, the visbreaker bottoms product stream possesses similar undesirable properties due to its high aromatic content. However, in the visbreaker bottoms product stream a significant amount of the aromatic content of the stream is in the form of asphaltenes. The visbreaker bottoms product stream normally has a high Conradson Carbon Residue (CCR) number which indicates the amount of coke (carbon) that a certain stream will produce. The high asphaltene content and high CCR content of the visbreaking bottoms product stream render it prohibitive to further catalytically process this stream and therefore, the visbreaking bottoms product stream is usually thermally cracked in a resid conversion unit such as a coker unit or diluted as required for sale as fuel oils. The problem that exists is that both the visbreaker gas oil products and the visbreaking bottoms products contain a significant amount of valuable high molecular weight saturated hydrocarbons with relatively low CCR content in the product streams which cannot be removed from the undesired highly aromatic, high CCR hydrocarbons through conventional fractionation techniques. These captured saturated hydrocarbons would make very valuable feedstocks to the refinery catalytic cracking processes if there were a process to selectively segregate these molecules from the aromatic hydrocarbons feedstream components. Since they cannot be removed in conventional visbreaking or fractionation processes, a significant amount of these high value, upgradeable hydrocarbon components are lost in thermal conversion processes.

Therefore, there exists in the art a need to separate from select visbreaker product streams a high value hydrocarbon stream with reduced CCR content and increased saturated hydrocarbons content for use as a feedstream to refinery and petrochemical catalytic upgrading processes.

SUMMARY OF THE INVENTION

The invention is a process utilizing an ultrafiltration separations unit to produce an improved hydrocarbon product stream with reduced CCR content and increased saturated hydrocarbons content from select visbreaker product streams for use as a feedstream for subsequent refinery or petrochemical catalytic cracking processes to produce improved fuel products.

In an embodiment, the present invention is a process for producing an improved hydrocarbon-containing product stream from a visbreaker product stream comprising:

a) conducting a hydrocarbon feedstream through a visbreaker reactor to form a visbreaker reactor outlet stream;

b) conducting the visbreaker reactor outlet stream to a visbreaker fractionator;

c) separating a visbreaker bottoms product stream from the bottom portion of the visbreaker fractionator;

d) conducting a visbreaker product feedstream comprising at least a portion of the visbreaker bottoms product stream into a membrane separations unit wherein the visbreaker product feedstream contacts a first side of at least one porous membrane element;

e) retrieving at least one permeate product stream from a second side of the porous membrane element, wherein the permeate product stream is comprised of selective materials which pass through the porous membrane from the first side of the porous membrane element and are retrieved in the permeate product stream from the second side of the porous membrane element; and f) retrieving at least one retentate product stream from the first side of the membrane;

wherein the CCR wt % content of the permeate product stream is at least 25% lower than the CCR wt % content of the visbreaker product feedstream.

In a preferred embodiment the porous membrane element has an average pore size of about 0.001 to about 2 microns. In yet another embodiment, the visbreaker product stream is conducted to the membrane separations, unit at a temperature from about 212° F. to about 662° F. (100 to about 350° C.).

In another embodiment of the present invention, the transmembrane pressure across the porous membrane element is from about 100 psi to about 2500 psi. In still another preferred embodiment, the visbreaker product feedstream has a final boiling point of at least 1100° F. (593° C.).

DETAILED DESCRIPTION OF THE PREFERRED EMBODIMENTS

What has been discovered is a process for upgrading select visbreaker product streams to produce a high value feedstream for further upgrading by catalytic cracking processes. The process of this invention produces a high molecular weight product stream with a reduced CCR content and increased saturated hydrocarbons content from select visbreaker product streams. The high value hydrocarbon stream produced by the current process cannot be obtained using conventional visbreaking technology.

The term "Micro Carbon Residue" (or "MCR") as used herein is a measure of carbon content of a sample as measured per test method ASTM D4530. The terms "Micro Carbon Residue" ("MCR") and "Conradson Carbon Residue" ("CCR") are considered as equivalent values as used herein and these terms are utilized interchangeably herein.

The term "average boiling point" or "median boiling point" as used herein is defined as the mass weighted average boiling point of the molecules in a mixture. This may be determined by simulated distillation gas chromatography (also referred to herein as "SIMDIS"). The term "initial boiling point" as used herein is defined as the temperature at which 5 wt % of the mixture is volatized at atmospheric (standard) pressure. The term "final boiling point" as used herein is defined as the temperature at which 95 wt % of the mixture is volatized at atmospheric (standard) pressure.

The term "transmembrane pressure" as used herein is defined as the difference in pressure as measured across a membrane element being the difference in pressure between the higher pressure feed/retentate side of the membrane element and the lower pressure permeate side of the membrane elements.

Figure 1:
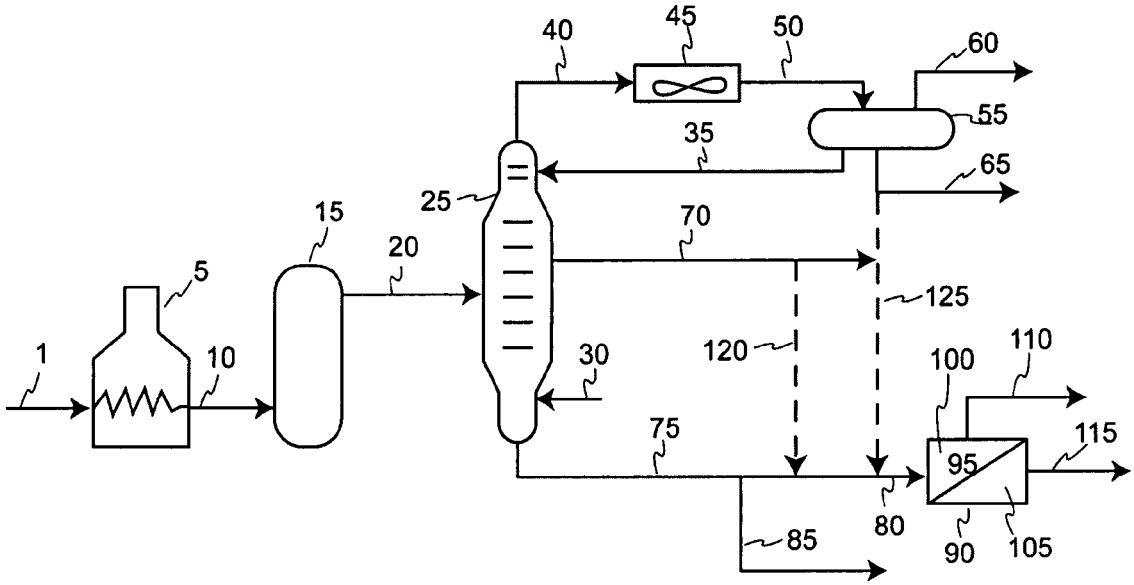
FIG. 1 hereof illustrates an embodiment of the current invention wherein select visbreaker process product stream(s) are separated utilizing the ultrafiltration process of the present invention to produce an improved catalytic cracking feedstream.

FIG. 1 illustrates a preferred embodiment of the present invention wherein the membrane separation process of the present invention is utilized on select visbreaker product stream(s) to produce a high value catalytic cracking feedstream. Referring to FIG. 1, a visbreaker feedstream (1) comprised of high molecular weight hydrocarbons is introduced into a visbreaking reactor (5). The visbreaker feedstream is usually produced from the heavy distillation fractionation cuts from a crude atmospheric fractionation tower and/or from a crude vacuum fractionation tower. Normally, the visbreaker feedstream will be comprised of crude atmospheric tower bottoms, crude vacuum tower gas oils, crude vacuum tower bottoms, or combinations thereof. In a preferred embodiment, the visbreaker feedstream is comprised of at least 50 vol % of crude vacuum tower bottoms product (or "vacuum resid"). In a more preferred embodiment, the visbreaker feedstream will be comprised of at least 75 vol % of crude vacuum tower bottoms product (or "vacuum resid").

In preferred embodiments, the visbreaker feedstream has an initial boiling point of above 600° F. (316° C.), more preferably above about 800° F. (427° C.). In a preferred embodiment, the visbreaker feedstream has a viscosity of at least 500 centistokes at 212° F. (100° C.), more preferably at least 750 centistokes at 212° F. (100° C.). In another preferred embodiment the viscosity of the visbreaker feed is from about 20 to about 1500 centistokes at 212° F. (100° C.).

Returning to FIG. 1, the visbreaker feedstream enters the visbreaker reactor at pressures from about 10 psig to about 750 psig. The feedstream is heated in the visbreaker reactor to reactor outlet stream temperatures of about 750° F. to about 950° F. (399° C. to 510° C.), preferably from about 800° F. to about 950° F. (427° C. to 510° C.). The visbreaker reactor outlet stream (10) may then be optionally fed to a soaker drum (15) and the outlet from the soaker drum (20) is then sent to the visbreaker fractionator (25). If the soaker drum is utilized in the process flow, it is preferred that the reactor outlet stream temperatures be kept below about 850° F. (454° C.). Alternatively, the soaker drum is not utilized in the process and reactor outlet stream (10) is fed directly to the visbreaker fractionator.

In the visbreaker fractionator, the incoming hot reactor outlet stream is quenched to a lower temperature in order to cease the visbreaking thermal reactions. A quench medium (30) is fed to the visbreaker fractionator to contact and cool the reactor outlet stream. Additionally, recycle streams such as, but not limited to, a condensed vapor stream (35) may be recycled to provide cooling to the fractionator and provide reflux to the fractionator's distillation process. Inside the visbreaker fractionator, the feedstream is distilled into multiple visbreaker product cuts. The fractionator overhead vapor stream (40) is sent to a condensing unit (45) in order to condense at least a portion of the fractionator overhead vapor stream producing a partially-condensed overhead vapor stream (50). This partially-condensed overhead vapor stream is then separated in an overhead knock-out drum (55) which separates the vapor phase material from the liquid phase material of the partially-condensed overhead vapor stream. The vapor phase material (60) consists mainly of butane and lighter hydrocarbons and is drawn off the overhead knock-out drum and sent for further processing or can be utilized for fuel gas. At least a portion of the liquid phase material is drawn off as a naphtha grade visbreaker product stream, herein referred to as the visbreaker naphtha product stream (65), and a portion of the stream may be recycled as a quench and/or a reflux (35) to the top portion of the visbreaker fractionator.

Distillates and different grades of gas oil range intermediate streams may be drawn from certain multiple elevations off of the visbreaker fractionator. For simplicity sake, FIG. 1 only illustrates a process where a single gas oil range intermediate stream, or visbreaker gas oil product stream, (70) is drawn from the visbreaker fractionator. However, there may be multiple intermediate streams in the gas oil or distillate ranges removed from the visbreaker fractionator. A visbreaker bottoms product stream (75) is also drawn from the bottom portion of the visbreaker fractionator.

In a preferred embodiment of the present invention, the membrane feedstream (80), containing at least a first portion of the visbreaker bottoms product stream (75) is conducted to a membrane separations unit (90). A second portion of the visbreaker bottoms product stream (85) may be segregated and sent for further processing in the refinery. In a preferred embodiment, the second portion of the visbreaker bottoms stream is sent as a feedstream to a coker unit. In a coker unit, the coker feedstream is heated to temperatures above about 900° F. (482° C.) to produce coke, which is a high carbon content solid material, as well as thermally cracked hydrocarbon products.

In another preferred embodiment, at least a portion of the visbreaker gas oil product stream (120) may be mixed with at least a portion of the visbreaker bottoms product stream (75) to produce the membrane feedstream (80). In yet another preferred embodiment, at least a portion of the visbreaker naphtha product stream (125) may be mixed with at least a portion of the visbreaker bottoms product stream (75) to produce the membrane feedstream (80). Conversely, a portion of all three streams, i.e., visbreaker naphtha product stream, the visbreaker gas oil product stream, and the visbreaker bottoms product stream may be mixed together to produce the membrane feedstream (80) to the membrane separations unit (90). Depending on the composition of the visbreaker bottoms stream, it may be beneficial to mix the visbreaker bottoms stream with some portion of these other visbreaker product streams or other lower molecular weight hydrocarbon streams, for example, a crude atmospheric or vacuum gas oil, to improve the flux and/or selectivity of the separations process of the current invention. Preferably, the membrane feedstream (80) has a final boiling point of at least 1100° F. (593° C.).

The membrane separations unit (90) comprises at least one membrane (95) and comprises at least one retentate zone (100) wherein the membrane feedstream contacts a first side of a permeable membrane and at least one permeate zone (105), wherein a permeate product stream is obtained from the opposite or second side of the membrane and is comprised of selective materials that permeate through the membrane (95). The retentate product stream (110) leaves the retentate zone (100), deplete of the extracted permeated components, and the permeate product stream (115) leaves the permeate zone (105) for further processing.

It is preferred that the membranes utilized in the present invention be constructed of such materials and designed so as to withstand prolonged operation at elevated temperatures and transmembrane pressures. In one embodiment of the present invention the membrane is comprised of a material selected from a ceramic, a metal, a glass, a polymer, or combinations thereof. In another embodiment, the membrane comprised of a material selected from a ceramic, a metal, or combination of ceramic and metal materials. Particular polymers that may be useful in embodiments of the present invention are polymers comprised of polyimides, polyamides, and/or polytetrafluoroethylenes provided that the membrane material chosen is sufficiently stable at the operating temperature of the separations process. In preferred embodiments, the membrane material has an average pore size of about 0.001 to about 2 microns (μm), more preferably about 0.002 to about 1 micron, and even more preferably about 0.004 to about 0.1 microns.

In a preferred embodiment of the present invention, the temperature of the membrane feedstream (80) prior to contacting the membrane system is at a temperature of about 212 to about 662° F. (100 to 350° C.), and more preferably from about 302 to about 572° F. (150 to 300° C.). The transmembrane pressure may vary considerably depending on the selectivity and the flux rates that are desired, but it is preferred if the transmembrane pressure is from about 100 to about 2500 psig, more preferably from about 250 to about 2000 psig and even more preferably from 500 to about 1500 psig.

In another preferred embodiment, the heavy hydrocarbon feedstream is flowed across the face of the membrane element (s) in a "cross-flow" configuration. In this embodiment, in the retentate zone, the heavy hydrocarbon feed contacts one end of the membrane element and flows across the membrane, while a retentate product stream is withdrawn from the other end of the retentate zone. As the feedstream/retentate flows across the face of the membrane, a composition selective in saturated compounds content flows through the membrane to the permeate zone wherein it is drawn off as a permeate product stream. In a cross-flow configuration, it is preferable that the Reynolds number in at least one retentate zone of the membrane separations unit be in the turbulent range, preferably above about 2000, and more preferably, above about 4000. In some embodiments, a portion of a retentate stream obtained from the membrane separation units may be recycled and mixed with the feedstream to the membrane separations unit prior to contacting the active membrane.

As can be seen in the examples below, an upgraded product stream may be obtained from a visbreaker bottoms stream, or conversely, a feedstream obtained by combining multiple streams from a visbreaker unit by the process of the present invention. As discussed prior, due to the undesirable components contained in the visbreaker bottoms product stream, this stream is conventionally sent to a process such as thermal coking which results in a high loss of the valuable components that are contained in the visbreaker bottoms product stream.

The process of the invention can be utilized to obtain a permeate product stream from a visbreaker product feedstream wherein the CCR wt % content of the permeate product stream is at least 25% lower than the CCR wt % content of the visbreaker product feedstream. More preferably the CCR wt % content of the permeate product stream at is at least 40% lower than the CCR wt % content of the visbreaker product feedstream, and even more preferably at least 50% lower than the CCR wt % content of the visbreaker product feedstream.

The permeate product stream thus obtained is of sufficiently low CCR wt % content to allow the permeate product stream to be utilized in various refinery catalytic processes. The retentate thus obtained is much lower in valuable product content and therefore can be subjected to thermal reduction processes without significant loss of valuable hydrocarbons. Additionally, since the retentate product stream obtained by the current process is lower in volumetric rate than the feedstream to the membrane process, the process of the current invention can also be utilized to debottleneck refinery heavy residual conversion units such as thermal coking units and minimize the quantity of residual oil sold as a blendstock for lower value fuel oil. It should be again noted that although the specific carbon content testing in the Examples herein was done n accordance with the Micro Carbon Residue Number ("MCR") test protocol, that the terms Micro Carbon Residue Number ("MCR") and Conradson Carbon Number ("CCR") are considered as equivalents herein and the terms are used interchangeable herein.

Another benefit of the current invention, is that weight percentage of the saturated hydrocarbons is increased in the permeate product obtained. This increased saturate content product stream is a valuable feedstock for refinery hydroprocessing units, isomerization units and fluid catalytic cracking units which can convert these saturates components into improved fuel products. As shown in Example 1 below, the present invention can result in a permeate product stream with a saturate content at least 5 wt % greater than the visbreaker product feedstream, and even more preferably at least 10 wt % greater than the visbreaker product feedstream.

Figure 2:
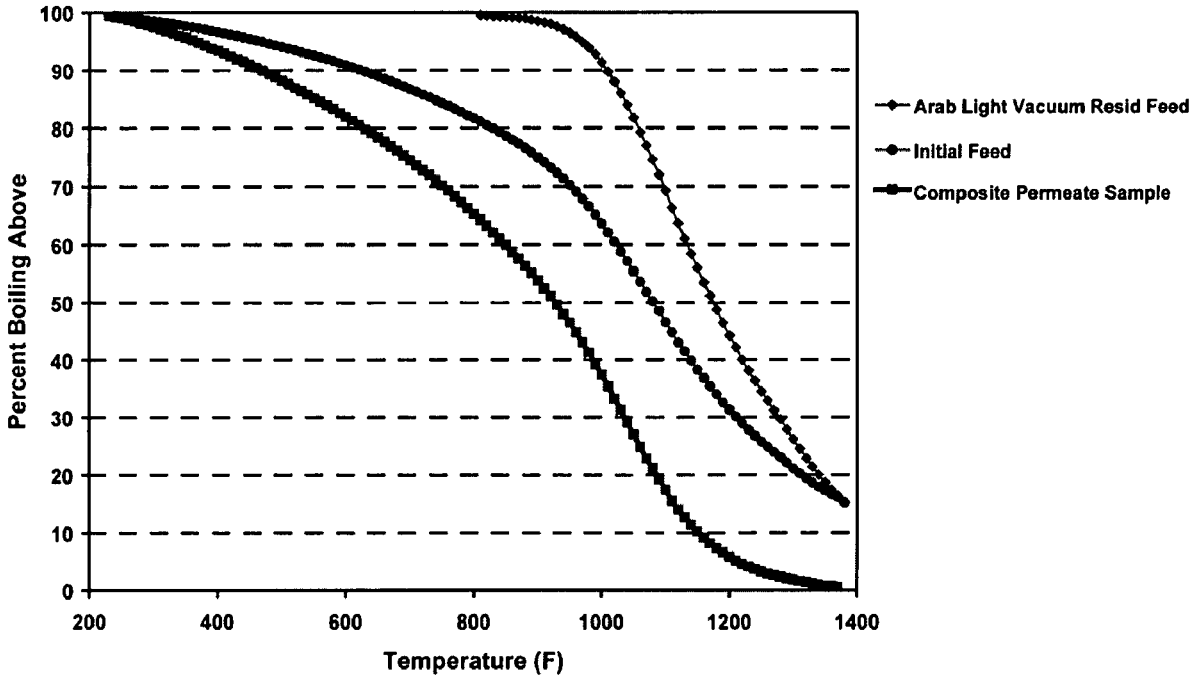
FIG. 2 hereof shows the boiling point curves for the feedstream to the visbreaker unit ("Arab Light Vacuum Resid Feed"), the feedstream to the membrane separations unit ("Initial Feed"), and the composite permeate product stream ("Composite Permeate Sample") from the tests performed as per Example 1 for separating a visbreaker product stream in accordance with one embodiment of the present invention.

Another benefit is that the median of the present invention is that the boiling point distribution of the permeate stream obtained stream can be significantly lowered as compared with the boiling point distribution of the visbreaker product stream. FIG. 2 shows curves corresponding to a visbreaker feedstream (labeled "Arab Light Vacuum Resid Feed"), a simulated visbreaker product stream (labeled "Initial Feed"), and a permeate stream (labeled "Composite Permeate Sample") obtained from one embodiment of the present invention. Example 1 herein further details the process by which this example was performed. It can be seen by viewing the boiling point distribution curve of the permeate stream ("Composite Permeate Sample") obtained from the membrane separations step of the current invention that the median boiling point (i.e., the 50% point on the boiling point distribution curve) of the Composite Permeate Sample was lowered by more than 100° F. as compared to the Initial Feed to the membrane separations unit. Additionally, only a very low percentage of 1200° F.+ boiling point components remained in the Composite Permeate Sample (only about 5 wt %). These lower boiling point products can be beneficial as feedstreams to additional process units and/or final product blending by producing a permeate stream with an increased percentage of components boiling at or below those utilized for motor fuels productions such as kerosene, diesels, and gasolines.

In addition, the process of the present invention can be utilized to reduce the metals content of a visbreaker product feedstream. Metals such as nickel and vanadium are contaminants to most refinery catalytic processes. These metals tend to adhere to the catalysts, reducing the useful activity of the catalysts resulting in lower unit conversions, more frequent catalyst replacement, increased unit downtime and loss of production, as well as increased catalyst materials and associated maintenance costs. Therefore, it is a frequent practice to send these high content metal streams to non-catalytic processes which result in a lower recovery of final valuable product than if these streams could be catalytically processed. The Examples herein show that a high quality permeate stream may be obtained from visbreaker product feedstream with a reduced metals content. In a preferred embodiment of the present invention, the permeate product stream is obtained with a nickel wt % content at least 50% lower than the nickel wt % content of the visbreaker product feedstream. More preferably, the nickel wt % content of the permeate product stream is at least 75% lower than the nickel wt % content of the visbreaker product feedstream. Similarly, in a preferred embodiment of the present invention, the permeate product stream is obtained with a vanadium wt % content at least 50% lower than the vanadium wt % content of the visbreaker product feedstream. More preferably, the vanadium wt % content of the permeate product stream is at least 75% lower than the vanadium wt % content of the visbreaker product feedstream.

The process of the present invention can also be utilized to produce a permeate product with a reduced sulfur wt % content of at least 10% lower, preferably at least 15% lower, than the visbreaker product feedstream to the membrane separations unit. As can be seen in Example 2 below, a permeate stream with a reduced sulfur wt % content of over 15% as compared to the visbreaker product feedstream to the membrane separations unit was obtained. This reduced sulfur stream can be utilized in catalytic processing units with sulfur content restrictions as well as result in intermediate products with reduced requirements on final product desulfurization resulting in reduced costs as well as capacity demand on refinery desulfurization units.

As seen, the process of the present invention can produce a permeate product stream from visbreaker product feedstreams, in particular, a visbreaker product feedstream comprised of a visbreaker bottoms product stream, wherein the permeate stream has sufficiently improved characteristics to allow processing of the permeate product stream in refinery catalytic processing units.

The Examples below illustrate the improved product qualities and the benefits of the current invention for producing an improved catalytic cracking feedstream from a visbreaker unit.

EXAMPLES

Example 1

In this Example, a sample of an Arab Light vacuum resid was thermally treated in an autoclave to simulate the conditions of a visbreaking process. In order to maximize the heat-up rate for simulating a visbreaker reactor, the autoclave was immersed in a molten tin bath at 770° F. The run was carried out in a nitrogen atmosphere at 350 psig with a flow rate of 0.5 liters/minute. The thermal treatment severity was 150 equivalent-seconds (equivalent to time at 875° F. assuming first order kinetics and an activation energy of approximately 53 kcal/mole). At this severity, the amount of toluene insolubles was approximately 2800 ppm. Toluene insolubles are a commonly used measure of the degree to which coke formation has progressed.

Approximately 9 wt % of autoclave overhead "light liquids", i.e., liquids boiling below about 650° F., was collected in a knockout vessel. The yield of light gases (butane and lighter) was approximately 3 wt %. The remainder of the product was drawn off as bottoms from the autoclave. A simulated visbreaker liquid product made as a feed sample for the separations test was made from about 91 wt % autoclave bottoms and about 9 wt % of the autoclave overhead light liquids to simulate a visbreaker total liquid product. Unless otherwise noted, the term "Initial Feed" as used herein is the composite feed made from approximately 91 wt % autoclave bottoms and approximately 9 wt % of the autoclave overhead light liquids obtained.

The simulated visbreaker liquid product was permeated in a batch membrane process using a 8 kD (kiloDalton) ceramic nanofiltration membrane. The pore size of this membrane was estimated to be in the 5-10 nm range. The transmembrane pressure was held at 1500 psig and the feed temperature was held at 200° C. The flux rates and permeate yields were measured during testing. The Autoclave Bottoms portion of the Initial Feed, the Permeates Samples and the final Retentate were tested in accordance with ASTM Method D-4530 for Micro Carbon Residue ("MCR") wt % and the values are shown in Table 1. The terms Conradson Carbon Number ("CCR") and Micro Carbon Residue Number ("MCR") are considered as equivalents and the terms are used interchangeable herein. The weight percentages of saturates, aromatics, resins, and polars for the Autoclave Bottoms portion of the Initial Feed, the Permeates Samples and the final Retentate from this example were also analyzed using the Iatroscan rapid thin layer chromatography technique and the results are tabulated in Table 1.

In analyzing the data in Table 1, many benefits of the present invention can be seen. In particular, some of the data points in Table 1 have been highlighted to help facilitate the analysis herein. Firstly, it can be seen that the Initial Feed had a MCR content of approximately 25.1 wt %. The MCR content of the Initial Feed was calculated based on analytical testing of the autoclave bottoms portion only of the Initial Feed composition and adjusting the results for the 9 wt % light liquids portion assuming a 0 wt % MCR content in the light liquids portion. It can be seen in Table 1 that the autoclave bottoms portion only of the Initial Feed composition as tested contained 27.6 wt % MCR.

The MCR values for the permeate samples were fairly consistent throughout the testing varying from about 6 to about 10 wt % CCR. This is very remarkable considering that over half of the sample was retrieved as a permeate product over the course of the test and the retentate MCR increased from 25.1 wt % MCR at the beginning of the test to approximately double the starting amount to 50.9 wt % MCR at the end of the test.

A composite permeate sample was prepared by mixing all of the permeate samples retrieved during the test. As can be seen, the Permeate Composite Sample had a value of 7.2 wt % MCR. Comparing this with the MCR content of the Initial Feed of 25.1 wt % MCR, the total reduction in MCR was 71.3%. It can be seen that even at the end of the test, as the MCR (or equivalent "CCR") content of the feed increased, that the MCR contents of the permeate samples were still low. This can be seen by analyzing the data for the last Permeate Sample 6 in Table 1, wherein the wt % MCR in Permeate Sample 6 was at 7.7 wt % MCR, which held close to the Permeate Composite Sample content of 7.2 wt % MCR. This shows that the membrane separations process of the present invention was able to achieve consistent MCR (or CCR) reductions over the course of the test even as the MCR content of the feedstream increased.

In a similar manner, the saturated hydrocarbons content of the permeate stream was dramatically improved by the process of the present invention. It can be seen from Table 1, that the Autoclave Bottoms portion of the Initial Feed had a Saturates content of 13.6 wt %. The Initial Feed consisted of about 91 wt % autoclave bottoms and about 9 wt % of the autoclave overhead light liquids as described above. Although the light liquids are composed almost exclusively of saturates and aromatics, the light liquids only compose 9% wt % of the Initial Feed utilized in this example and therefore are believed to have minimal impact on the overall aromatic and saturates contents of the Initial Feed composition.

TABLE 1

| Sample | Trans-membrane Pressure (psi) | Feedstream Temperature (° C.) | Permeate Flux Rate (gal/ft$^2$/day) | Permeate Yield, Cumulative (% of Initial Feed) | MCR (wt %) | % Reduction of MCR (compared to the Initial Feed) | % Reduction of MCR (compared to the Retentate) | Saturates (wt %) | Aromatics (wt %) | Resins (wt %) | Polars (wt %) |
|---|---|---|---|---|---|---|---|---|---|---|---|
| Autoclave Bottoms (portion of the Initial Feed) | | | | | 27.6 | | | 13.6 | 50.8 | 16.0 | 19.7 |
| Initial Feed[(1)] (Autoclave bottoms + 9 wt % light liquids) | | | | | 25.1 | | | | | | |
| Permeate Sample 1 | 1500 | 200 | 1.25 | 10.1 | 6.1 | 75.1 | | 24.2 | 70.9 | 4.9 | — |
| Permeate Sample 2 | 1500 | 200 | 0.90 | 16.1 | 6.0 | 76.1 | | 21.4 | 74.4 | 4.2 | — |
| Permeate Sample 3 | 1500 | 200 | 0.47 | 29.2 | 6.5 | 74.1 | | 22.1 | 73.4 | 4.0 | 0.7 |

TABLE 1-continued

| Sample | Trans-membrane Pressure (psi) | Feedstream Temperature (° C.) | Permeate Flux Rate (gal/ft$^2$/day) | Permeate Yield, Cumulative (% of Initial Feed) | MCR (wt %) | % Reduction of MCR (compared to the Initial Feed) | % Reduction of MCR (compared to the Retentate) | Saturates (wt %) | Aromatics (wt %) | Resins (wt %) | Polars (wt %) |
|---|---|---|---|---|---|---|---|---|---|---|---|
| Permeate Sample 4 | 1500 | 200 | 0.21 | 38.2 | 7.7 | 69.3 | | 18.5 | 76.9 | 4.1 | 1.0 |
| Permeate Sample 5 | 1500 | 200 | 0.08 | 48.8 | 9.8 | 61.0 | | 16.6 | 78.1 | 5.3 | — |
| Permeate Sample 6 | 1500 | 200 | 0.04 | 50.9 | 7.7 | 69.3 | 84.9 | 13.3 | 79.9 | 6.5 | 0.6 |
| Retentate | 1500 | 200 | | | 50.9 | | | 2.4 | 53.1 | 11.5 | 33.0 |
| Permeate Composite Sample | 1500 | 200 | | | 7.2 | 71.3 | 85.9 | 23.6 | 67.8 | 7.9 | 0.9 |

(1)MCR content of the Initial Feed was calculated based on analytical testing of the autoclave bottoms portion of the Initial Feed only (91 wt % of the Initial Feed) and adjusting the result for the 9 wt % light liquids portion assuming a 0 wt % MCR content in the light liquids portion.

It can be seen in Table 1 that the Permeate Composite Sample has a Saturates content of 23.6 wt %. This is over a 70% increase in saturates content. Although the Saturate content of the permeate samples dropped as the test progressed, it is believed that this is not an indication of any significant loss in saturates separation performance from the process, but rather is a function of the decreasing saturated hydrocarbons in the retentate. In fact, comparing the saturates content of the last Permeate Sample 6 of 13.3 wt % to the final Retentate sample which had a saturates content of only 2.4 wt %, the process of the present invention was obtaining a 400%+increase in saturates content of the permeate near the end of the test.

As demonstrated by this example, the process of the present invention can produce a product stream with significantly reduced CCR content and improved saturates content from a visbreaker unit product stream.

Additionally, the membrane separations process of the present invention produces a permeate product stream from a visbreaker product stream with a significantly reduced boiling point distribution. This is shown in FIG. 2 which shows the boiling point distributions corresponding to the samples of the Initial Feed to the membrane separations unit and the Permeate Composite Sample of this Example as well as the boiling point distribution of the Arab Light vacuum resid that was utilized to produce the visbreaker product used in the membrane separations test of this example. The results shown in FIG. 2 were obtained through simulated distillation by gas chromatography (or "SIMDIS") analysis.

As can be seen in FIG. 2, the boiling point distribution of the stream was significantly improved (lowered) from the curve corresponding to the "Arab Light Vacuum Resid Feed" to the visbreaking step of the current invention to the curve corresponding to the "Initial Feed" to the membrane separations step of the current invention. It can be seen by viewing the boiling point distribution curve of the "Composite Permeate Sample" obtained from the membrane separations step of the current invention that the median boiling point (i.e., the 50% point on the boiling point distribution curve) of the "Composite Permeate Sample" was lowered by more than 100° F. as compared to the Initial Feed to the membrane separations unit. Additionally, only a very low percentage of 1200° F.+ boiling point components remained in the "Composite Permeate Sample" (only about 5 wt %).

Example 2

Samples of the Autoclave Bottoms Portion of the Initial Feed, the Permeate Composite Sample, and the Retentate from Example 1 were also analyzed to determine the capability of the present invention to remove metals and sulfur from a visbreaker product stream. The nickel, vanadium and sulfur content of the Initial Feed were calculated based on analytical testing of the autoclave bottoms portion only and the results adjusted for the additional 9 wt % light liquids assuming a 0 ppm content of nickel, vanadium and sulfur in the light liquids portion of the Initial Feed. Table 2 summarizes the data obtained from these analyses.

TABLE 2

| Sample | Nickel (ppm) | Vanadium (ppm) | Sulfur (wt %) |
|---|---|---|---|
| Initial Feed(1) (Autoclave bottoms + 9 wt % light liquids) | 22.8 | 75.5 | 3.9 |
| Composite Permeate Sample | 3.5 | 11.6 | 3.2 |
| Retentate | 58.1 | 199.0 | 5.0 |
| % Reduction in Composite Permeate Sample | 84.6 | 84.6 | 17.9 |

(1)Nickel, vanadium and sulfur content of the Initial Feed were calculated based on analytical testing of the autoclave bottoms portion of the Initial Feed only (91 wt %) and adjusting the result for the 9 wt % light liquids portion assuming a 0 ppm nickel, vanadium and sulfur content in the light liquids portion.

As can be seen, in addition to the improvements in CCR content and saturates content, as shown in Example 1 above, the present invention results in a permeate product stream obtained from visbreaker product streams with significantly reduced amounts of metal contaminants as well as a reduced sulfur content.

Although the present invention has been described in terms of specific embodiments, it is not so limited. Suitable alterations and modifications for operation under specific conditions will be apparent to those skilled in the art. It is therefore intended that the following claims be interpreted as covering all such alterations and modifications as fall within the true spirit and scope of the invention.

What is claimed is:

1. A process for producing an improved hydrocarbon-containing product stream from a visbreaker product stream comprising:

a) conducting a hydrocarbon feedstream through a visbreaker reactor to form a visbreaker reactor outlet stream;

b) conducting the visbreaker reactor outlet stream to a visbreaker fractionator;

c) separating a visbreaker bottoms product stream from the bottom portion of the visbreaker fractionator;

d) conducting a visbreaker product feedstream comprising the visbreaker bottoms product stream without a solvent into a membrane separations unit wherein the visbreaker product feedstream contacts a first side of at least one porous membrane element;

e) retrieving at least one permeate product stream from a second side of the porous membrane element, wherein the permeate product stream is comprised of selective materials which pass through the porous membrane from the first side of the porous membrane element and are retrieved in the permeate product stream from the second side of the porous membrane element; and f) retrieving at least one retentate product stream from the first side of the membrane;

wherein the transmembrane pressure across the porous membrane element is from about 500 psi to about 1500 psi, and wherein the CCR wt % content of the permeate product stream is at least 25% lower than the CCR wt % content of the visbreaker product feedstream.

2. The process of claim 1, wherein the porous membrane element has an average pore size of about 0.001 to about 2 microns.

3. The process of claim 2, wherein the visbreaker product stream is conducted to the membrane separations unit at a temperature from about 212° F. to about 662° F. (100 to about 350° C.).

4. The process of claim 3, wherein the hydrocarbon feedstream is comprised of at least 50 vol % of a vacuum resid and the visbreaker product feedstream has a final boiling point of at least 1100° F. (593° C.).

5. The process of claim 4, wherein the median boiling point of the permeate product stream is at least 100° F. (56° C.) lower than the median boiling point of the visbreaker product feedstream.

6. The process of claim 5, wherein the saturated hydrocarbons content of the permeate product stream is at least 5 wt % greater than the saturated hydrocarbons content of the visbreaker product stream.

7. The process of claim 6, wherein the porous membrane element is comprised of a material selected from the group consisting of ceramic, metal, glass, polymer, and combinations thereof.

8. The process of claim 7, wherein nickel wt % content of the permeate product stream is at least 50% lower than the nickel wt % content of the visbreaker product feedstream, and the vanadium wt % content of the permeate product stream is at least 50% lower than the vanadium wt % content of the visbreaker product feedstream.

9. The process of claim 8, wherein the permeate product stream has a sulfur wt % content of at least 10% lower than the visbreaker product feedstream.

10. The process of claim 9, wherein the porous membrane element has an average pore size of about 0.002 to about 1 micron.

11. The process of claim 10, wherein the porous membrane element is comprised of a material selected from the group consisting of ceramic, metal, and combinations thereof.

12. The process of claim 11, wherein the hydrocarbon feedstream has a viscosity of at least 500 centistokes at 212° F. (100° C.).

13. The process of claim 12, wherein at least a portion of the permeate product stream is further processed in a catalytic process unit.

14. The process of claim 13, wherein the catalytic process unit is a fluid catalytic cracking unit, a hydrocracking unit, or an isomerization unit.

15. The process of claim 12, wherein the visbreaker product feedstream is comprised of an intermediate refinery product stream selected from a visbreaker gas oil stream, a crude atmospheric gas oil stream and a crude vacuum gas oil stream.

16. The process of claim 15, wherein the visbreaker product feedstream is comprised of at least 50 wt % of a visbreaker bottoms product.

17. The process of claim 16, wherein the CCR wt % content of the permeate product stream is at least 40% lower than the CCR wt % content of the visbreaker product feedstream.

18. The process of claim 17, wherein the saturated hydrocarbons content of the permeate product stream is at least 10 wt % greater than the saturated hydrocarbons content of the visbreaker product stream.

* * * * *